US006375513B1

(12) United States Patent
Stich

(10) Patent No.: US 6,375,513 B1
(45) Date of Patent: Apr. 23, 2002

(54) LAMPHOLDER

(75) Inventor: Richard A. Stich, Saluda, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/564,319

(22) Filed: May 3, 2000

(51) Int. Cl.[7] ..... H01R 33/22; H01R 9/24; H01R 13/02

(52) U.S. Cl. ..... 439/667; 439/886

(58) Field of Search ..... 439/236, 226, 439/619, 340, 667, 886

(56) References Cited

U.S. PATENT DOCUMENTS 3,568,133 A 3/1971 Johnson
5,458,026 A 10/1995 Southard et al.
5,698,935 A * 12/1997 Newman ..... 313/318.04
5,788,525 A * 8/1998 Newman et al. ..... 439/307
5,874,800 A 2/1999 Newman
6,008,570 A * 12/1999 Helbig et al. ..... 313/318.01

* cited by examiner

*Primary Examiner*—Khiem Nguyen
*Assistant Examiner*—Chandrika Prasad
(74) *Attorney, Agent, or Firm*—Pearne & Gordon LLP

(57) ABSTRACT

An electric lampholder is provided with a cantilevered center contact. The contact is formed from a spring-like material. The portion of the contact that contacts the lamp eyelet is composed of a material having an electrical resistance less than that of the spring-like material.

8 Claims, 1 Drawing Sheet

LAMPHOLDER

BACKGROUND OF THE INVENTION

The present invention relates to electrical lampholders and, in particular, to a lampholder having a cantilevered center contact.

The center contact of a lampholder for an electric lamp should provide a reliable current path from the lampholder to the eyelet of the lamp base. The contact itself should have low resistance and there should be low resistance between the contact and the lamp eyelet. In addition, the contact should provide and maintain an adequate contact force between the contact and the eyelet. The contact (and lampholder) should also not degrade at temperatures up to 200 degrees Centigrade.

Mogul lampholders (and larger) have difficulty in providing all of the above functionality with a single element contact structure. Historically these contacts have been formed from nickel plated brass, or other good conductors, backed by a coil spring. The contact material provides the desired electrical properties and the coil spring provides the desired springing contact force.

Recent mogul lampholders have employed a single element cantilevered spring steel contact structure. Such contacts may consist of stainless steel type 302. These contacts have not proven to be entirely satisfactory. In many cases, these contacts have either burned up themselves and/or burned up the lamp eyelet. These failures have been exacerbated by higher wattage lamps (e.g., 400 watts and greater).

SUMMARY OF THE INVENTION

A lampholder for an electric lamp includes an insulating socket, a circumferential contact located inside the socket and a cantilevered contact. The cantilevered contact has a first end and a second end, where the first end is attached to the socket and the second end is adapted to make springing electrical contact with the lamp. The cantilevered contact is formed from a spring-like material and has a lamp contacting portion composed of a material having an electrical resistance less than that of the spring-like material.

DESCRIPTION OF THE PREFERRED EMBODIMENTS

Figure 1:
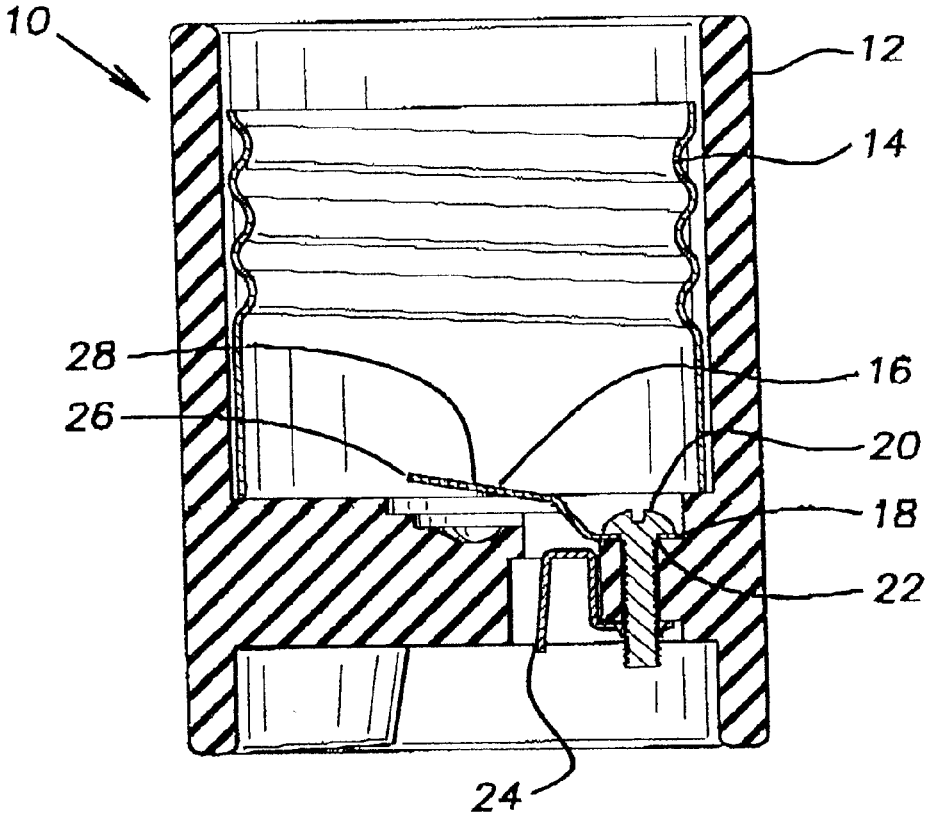
FIG. 1 is a cross sectional view through the center axis of a lampholder according to the invention.

Referring to FIG. 1, a lampholder 10 includes an insulating socket 12 in a cup-like shape. The socket 12 may be, for example, formed from a porcelain ceramic. A circumferential contact 14 is attached to the bottom of the socket 12 by unshorn fasteners that may also provide an electrical power connection to the circumferential contact 14. The circumferential contact 14 may be, for example, a metal shell formed in a threaded shape for mating with a screw base lamp. The circumferential contact 14 can also be some other shape suitable for surrounding and mating with the base of a lamp, for example, a bayonet base lamp.

A cantilevered contact 16 is fastened at a first end 18 to the socket 12 by a screw 20 that passes through an aperture

22 in the first end 18. The screw 20 passes through the bottom of the socket 12 and is threaded into a connector 24. Electrical power may be applied to the cantilevered contact 16 by way of the connector 24 and the screw 20. The screw 20 and the connector 24 may be, for example, formed of brass.

The cantilevered contact 16 is cantilevered from the screw 20 toward the center of the socket 12. The second end 26 of the cantilevered contact 16 is unsupported above the bottom of the socket 12.

Figure 2:
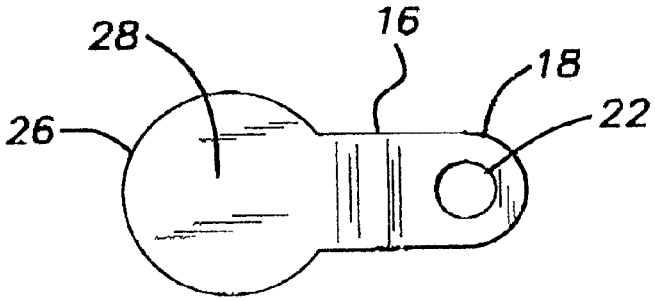
FIG. 2 is a top plan view of a cantilevered contact according to the invention.

Referring to FIG. 2, the second end 26 of the cantilevered contact 16 may be advantageously generally circular with the first end 18 extending tab-like from the second end 26. The first end 18 is provided with an aperture 22 for the screw 20. The diameter of the second end 26 is selected to correspond to the eyelet or other central contact of the lamp to be used in the lampholder 10. In general, the upper surface of the second end 26 will correspond to a lamp contacting portion 28. The first end 18 is sized for the desired physical strength and electrical capacity.

Figure 3:
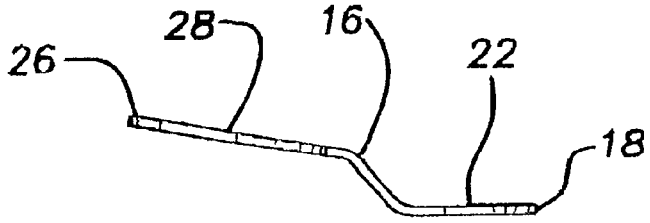
FIG. 3 is a side elevation view of the contact of FIG. 2.

Referring to FIG. 3, the cantilevered contact 16 may be advantageously generally flat with a bent cross section suitable to locate the second end 26 slightly above the bottom the socket 12 when the first end is fastened to the socket 12.

In the preferred embodiment the cantilevered contact 16 is formed from a spring-like material such as spring steel having a thickness, for example, of between 0.02 and 0.06 inches. The cantilevered contact 16 may be, for example, stainless steel type 302.

The spring-like material construction of the cantilevered contact 16 ensures that the contacting portion 28 makes springing electrical contact with the eyelet or other central contact of the lamp to be used in the lampholder 10.

Unfortunately, practical spring-like materials like stainless steel type 302 can provide too much contact resistance between the cantilevered contact 16 and the lamp. This results in burning up the cantilevered contact 16 and/or the lamp contact. In addition, in the case of lamp contacts coated with a soft material like solder, the lamp contact can not break through any chrome oxide layer on the cantilevered contact 16, further exacerbating the excessive contact resistance problem. The chrome oxide forms on stainless steel contacts that carry moderate to heavy current and is exacerbated by vibration and heat.

The present invention avoids this contact resistance problem. In the present invention, the lamp contacting portion 28 is formed from a material having an electrical resistance less than that of the spring-like material. The lamp contacting portion 28 may be, for example, nickel plating having a thickness of 0.0001 to 0.0003 inches. A dull or semi-bright nickel finish processed for electrical connection and adhesion to stainless steel in flexural is suitable.

In another embodiment, the lamp contacting portion 28 is copper cladding having a thickness of 0.001 to 0.005 inches This cladding is similar to the process used to create U.S. coins with copper cores and stainless steel exteriors. Such materials are manufactured by Texas Instruments. However, the copper is more susceptible to oxidation than the nickel.

It is also possible to use other material for the contacting portion 28, for example, nickel, copper, brass, cupro-nickel, silver, gold and platinum could be used either alone or in combination.

The material of the contacting portion 28 may be applied, for example, not only by plating or cladding, but also by welding, or other heat resistant/electrically conductive methods. The material can be applied just to the contacting portion 28, the top side of the cantilevered contact 16, the entire surface of the cantilevered contact 16, or to any convenient portion that includes the contacting portion 28.

The lampholder 10 may be, for example, a mogul lampholder or larger. Mogul lampholders are typically used with higher wattage lamps (for example, 400 watts and above) which typically operate at higher temperatures. The lampholder 10 will perform well at temperatures up to 200 degrees Centigrade and with lamp wattage up to 1000 watts.

It should be noted that the lampholder 10 is orientated as shown in FIG. 1 merely for convenience in describing the embodiment shown. The lampholder 10 may of course be orientated in any direction.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A lampholder for a mogul type or larger electric lamp, said lampholder comprising:

an insulating socket adapted to receive said lamp;

a circumferential contact located inside said socket; and a cantilevered contact having a first end and a second end, said first end being attached to said socket and said second end being adapted to make springing electrical contact with said lamp, wherein said cantilevered contact is formed from a spring-like material and has a lamp contacting portion composed of a material having an electrical resistance less than that of said spring-like material, said cantilevered contact being adapted to operate at a temperature of up to 200 degrees Centigrade, wherein said lamp is 400 watts or greater.

2. A lampholder according to claim 1, wherein said portion is composed of at least one of nickel, copper, brass, cuprous-nickel, silver, gold and platinum.

3. A lampholder according to claim 1, wherein said spring-like material is a spring steel.

4. A lampholder according to claim 1, wherein said spring-like material is stainless steel type 302.

5. A lampholder according to claim 1, wherein said portion is provided on said cantilevered contact by plating or cladding.

6. A lampholder according to claim 1, wherein said portion is nickel plating having a thickness of 0.0001 to 0.0003 inches.

7. A lampholder according to claim 1, wherein said portion is copper cladding having a thickness of 0.001 to 0.005 inches.

8. A lampholder according to claim 1, wherein said material having an electrical resistance less than that of said spring-like material extends from said first end to said second end.

* * * * *

UNITED STATES PATENT AND TRADEMARK OFFICE

CERTIFICATE OF CORRECTION

PATENT NO. : 6,375,513 B1
DATED : April 23, 2002
INVENTOR(S) : Stich

It is certified that error appears in the above-identified patent and that said Letters Patent is hereby corrected as shown below:

Column 1,
Line 59, please delete “unshorn” and insert therefor -- unshown --.

Column 4,
Line 14, please delete “cuprous-nickel” and insert therefor -- cupro-nickel --.

Signed and Sealed this

Ninth Day of July, 2002

*Attest:*

*Attesting Officer*

JAMES E. ROGAN
*Director of the United States Patent and Trademark Office*